US009410666B2

(12) United States Patent
Camenzuli et al.

(10) Patent No.: US 9,410,666 B2
(45) Date of Patent: Aug. 9, 2016

(54) MODULAR LAMP

(71) Applicant: Karibu Solar Power Inc., Toronto (CA)

(72) Inventors: Brian Camenzuli, Bowmanville (CA); Adam Matthew Camenzuli, Bowmanville (CA)

(73) Assignee: Karibu Solar Pauer Inc., Toronto (CA)

( * ) Notice: Subject to any disclaimer, the term of this patent is extended or adjusted under 35 U.S.C. 154(b) by 66 days.

(21) Appl. No.: 14/168,712

(22) Filed: Jan. 30, 2014

(65) Prior Publication Data

US 2015/0211694 A1 Jul. 30, 2015

(51) Int. Cl.

| | |
|---|---|
| ***F21L 4/04*** | (2006.01) |
| ***F21L 4/08*** | (2006.01) |
| ***F21V 3/04*** | (2006.01) |
| ***F21V 23/00*** | (2015.01) |
| ***F21L 4/00*** | (2006.01) |
| ***F21S 8/00*** | (2006.01) |
| ***F21S 9/03*** | (2006.01) |
| *F21W 131/30* | (2006.01) |
| *F21Y 101/02* | (2006.01) |

(52) U.S. Cl.

CPC . *F21L 4/08* (2013.01); *F21L 4/005* (2013.01); *F21S 8/03* (2013.01); *F21S 9/032* (2013.01); *F21V 3/049* (2013.01); *F21V 23/005* (2013.01); *F21W 2131/30* (2013.01); *F21Y 2101/02* (2013.01)

(58) Field of Classification Search

CPC ..... F21L 4/06; F21L 4/08; F21L 4/085; F21L 4/005; F21L 4/027; F21L 4/04; F21L 4/045; F21S 9/032; F21S 2/005; F21V 17/002; F21V 17/12; F21V 23/06; F21V 23/001; F21V 23/002; F21V 23/0414; F21V 23/0421; F21V 23/0428; F21V 19/0025; F21V 19/0055; H01R 13/207; H01R 13/622; H01R 13/623; H01R 13/7175; H01R 33/22; H01R 33/225

USPC ..... 439/339, 340, 360

See application file for complete search history.

(56) References Cited

U.S. PATENT DOCUMENTS

| | | | | |
|---|---|---|---|---|
| 5,432,689 | A | 7/1995 | Sharrah et al. | |
| 6,290,367 | B1 | 9/2001 | Greenhoe et al. | |
| 6,583,540 | B2 | 6/2003 | Al-Refai | |
| 6,812,398 | B2 | 11/2004 | Yueh | |
| 7,021,787 | B1 * | 4/2006 | Kuelbs | 362/183 |
| 7,377,667 | B2 | 5/2008 | Richmond | |
| 7,513,638 | B2 | 4/2009 | Allsop et al. | |
| 7,524,079 | B2 | 4/2009 | Greenhoe | |

(Continued)

*Primary Examiner* — Anh Mai
*Assistant Examiner* — Steven Horikoshi
(74) *Attorney, Agent, or Firm* — Matthew Thurlow

(57) ABSTRACT

A modular solar lamp is provided. The lamp has three detachable modules: a solar panel module, a battery/light module, and a diffuser module. The battery/light module has a battery connected to a light. Electrical connectors are located on a surface of the body and are electrically connected with the battery. The solar module has a solar panel exposed on its top surface for converting solar energy into electrical energy. Electrical connectors are located on a surface of the module and are electrically connected to the solar panel. The electrical connection is established between the solar panel and the battery module when the two modules are fully secured to each other thus establishing an electrical connection between the solar panel and the battery through the connectors. Once the battery is charged, the solar panel module may be detached and used to charge the battery of another lamp.

13 Claims, 21 Drawing Sheets

(56) References Cited

U.S. PATENT DOCUMENTS

| | | | | |
|---|---|---|---|---|
| 8,256,916 | B2 | 9/2012 | Richmond | |
| 2006/0098440 | A1* | 5/2006 | Allen | 362/294 |
| 2009/0047863 | A1* | 2/2009 | Capriola | A63H 33/042 446/91 |
| 2009/0207597 | A1 | 8/2009 | Silver | |
| 2010/0027249 | A1* | 2/2010 | Connor et al. | 362/183 |
| 2010/0214774 | A1 | 8/2010 | Liu et al. | |
| 2011/0205730 | A1* | 8/2011 | Richmond | 362/183 |
| 2011/0216529 | A1* | 9/2011 | Weng | 362/183 |
| 2012/0134143 | A1 | 5/2012 | Lederer et al. | |
| 2012/0155067 | A1 | 6/2012 | Jensen et al. | |

* cited by examiner

MODULAR LAMP

FIELD OF THE APPLICATION

The present application relates to artificial lighting, and more particularly, to a modular lamp.

BACKGROUND OF THE APPLICATION

Over half a billion people in Africa lack adequate access to artificial light and energy. This Is a major barrier from breaking free from poverty. To obtain artificial light once darkness has fallen, kerosene lamps are typically used. Such lamps are dangerous and sometimes deadly to their users; they are also hazardous to the environment. Their toxic fumes are a leading cause of death for women and children. Furthermore, the use of kerosene emits over 100 million tons of greenhouse gases every year.

Over the past few decades, there has been an increase in the prevalence of renewable energy solutions to those lacking adequate access to light and energy. Although partly successful, these efforts have been unable to scale to the point of making a sizeable impact. Current solar solutions are often too expensive and unreliable.

Portable solar lamps are a cheap and easy way to provide light. Solar lamps generally include a solar panel configured to generate power for a light source within the solar lamp. The solar panel captures and converts solar energy into electrical energy. A battery connected, to the solar panel stores the electrical power which is used to power the light source. Conventional solar lamps often have the solar panel affixed to the body of the solar lamp. To recharge the battery, the user must place the entire solar lamp into the sunlight for an extended period of time. Frequent moving of the solar lamp from Inside the house to outside is impractical and time consuming.

Accordingly, there remains a need for improvements in the art.

BRIEF SUMMARY OF THE INVENTION

According to one aspect of the present invention, there is provided a modular lamp. The modular lamp comprises a first module having a thread formation, the first module comprising a light source for emitting light a rechargeable power source for storing electrical, power, the rechargeable power source being in electrical communication with the light source for transmitting electrical, power from the rechargeable power source to the light source and a first electrical connecting means being In electrical communication with the rechargeable power source; a second module having a thread formation configured for mating with the thread formation of the first module, the second module comprising a solar panel assembly for converting solar power into electrical, power and second electrical connecting means being in electrical communication with the solar panel assembly, whereby when the first module is releasably secured to the second module by rotatably engaging the thread, formation of the first module with the thread formation of the second module, the first electrical connecting means is engaged with the second electrical connecting means thereby allowing electrical communication between the solar panel assembly and the rechargeable power source.

According to another aspect of the present invention, them is provided a modular lamp having a first module housing a rechargeable power source and a light source, and a second module having a solar panel. The modular lamp may also have a diffuser or a third module being configured for dispersing light emitted by the light source. When placed in an environment with sufficient solar intensity, the solar panel may recharge the rechargeable power source powering the light source. Once the rechargeable power source is recharged, the second, module may be detached from the first module and be used to recharge the rechargeable power source of another modular lamp. Because of the modular nature of the modular lamp, the third module may be easily detached from the first module, thus providing a compact assembly to be recharged allowing a user to carry with ease a first module to be recharged or once recharged from one location to another location.

According to another aspect of the present invention, there is provided a modular lamp which may have a plurality of configurations adaptable for different uses and functions. The modular lamp may be easily carried, recharged, used as a table lamp, a flash light or releasably secured to a wall or ceiling to light up a room.

According to another aspect of the present invention, there is provided an apparatus for use with a module comprising a thread formation and a power source assembly lit electrical communication with a first electrical connecting means. The apparatus comprises a hotly having a thread formation being configured to mate with the thread formation of the module for releasably securing the body to the module, the body comprising a light source for emitting light, a rechargeable power source for storing electrical power, the rechargeable power source being in electrical communication with the light source for transmitting electrical power from the rechargeable power source to the light source; and second electrical connecting means being in electrical communication with the rechargeable power source, whereby when the body is releasably secured to the module by rotatably engaging the thread formation of the body with the thread formation of the module, the first, electrical connecting means is engaged with the second electrical connecting means thereby allowing electrical communication between the power source assembly and the rechargeable power source.

According to another aspect of the present invention, there is provided an apparatus for use with a module comprising a thread formation, a light source for emitting light, a rechargeable power source for storing electrical power, the rechargeable power source being in electrical communication with the light source for transmitting electrical power from the rechargeable power source to the light source and a first electrical connecting means being in electrical communication with the rechargeable power source. The apparatus comprises a body having a thread formation being configured for mating with the thread formation of the module for releasably securing the body to the light module, the body comprising a power source assembly for providing electrical power; and second, electrical connecting means being in electrical connection, with the power source assembly, whereby when the body is releasably secured to the module by rotatably engaging the thread formation of the body with the thread formation of the module, the first electrical connecting means is engaged with the second electrical connecting means thereby allowing electrical communication between the power source assembly and the rechargeable power source.

According to another aspect of the present invention, there is provided a wall mount for releasably securing the apparatus of the invention. The wall mount, comprises a body having a thread formation configured for mating with the thread formation of the apparatus when the apparatus is releasably secured to the body; and fastening means for fastening the body to a supportive surface.

Other aspects and features according to the present application will become apparent, to those ordinarily skilled in the art upon review of the following description of embodiments of the invention in conjunction with the accompanying figures.

BRIEF DESCRIPTION OF THE DRAWINGS

Reference will now be made to the accompanying drawing which shows, by way of example, embodiments of the invention and how they may be carried into effect and in which.

Like reference numerals indicate like or corresponding elements in the drawings.

DETAILED DESCRIPTION OF THE EMBODIMENTS

Figure 1:
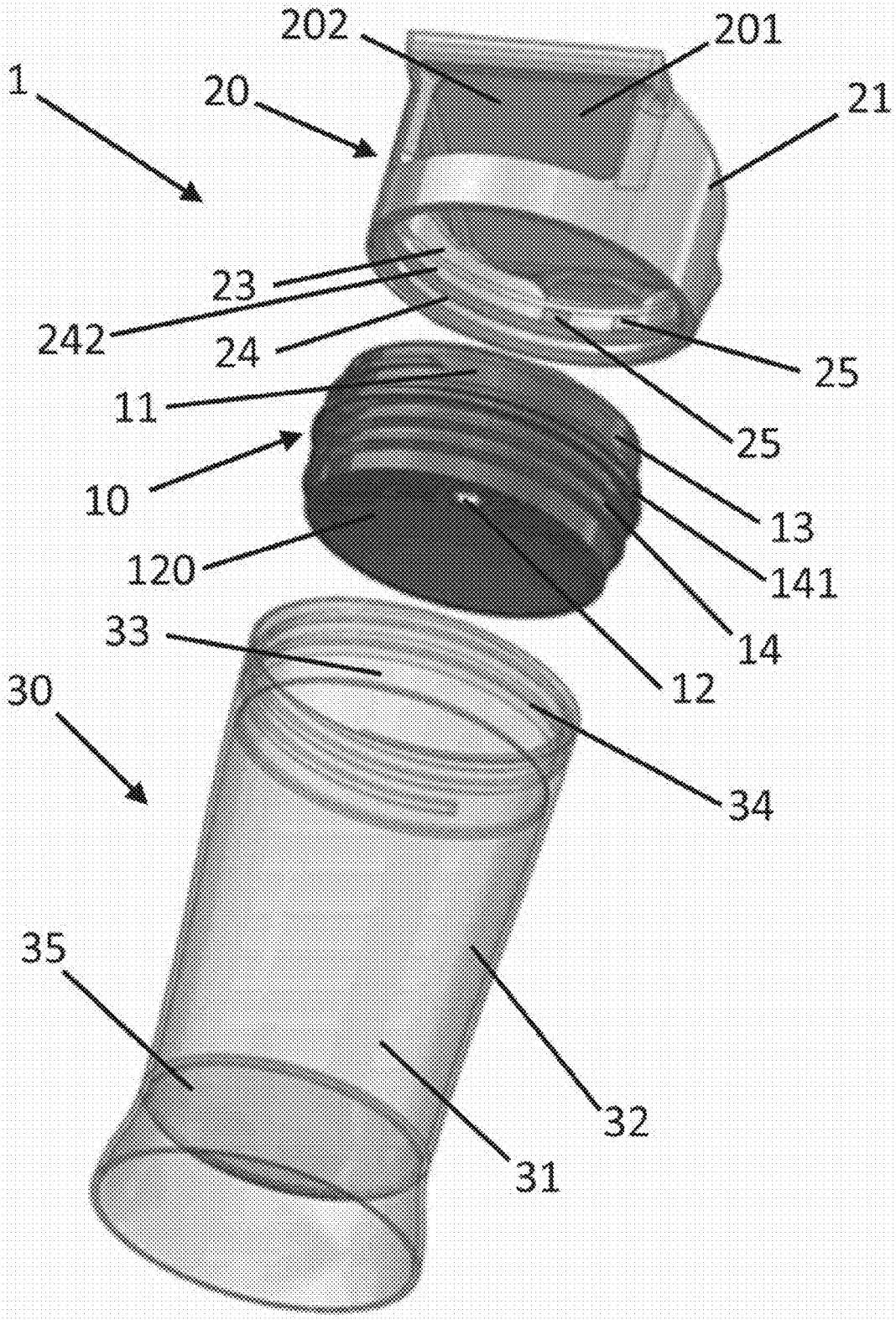
FIG. 1 illustrates a front perspective exploded view of a modular lamp according to an embodiment of the invention.

There is described a modular lamp, such, as modular solar lamp 1 as shown in FIGS. 1 to 5B and 7 to 8B. The modular solar lamp 1 may comprise a first module 10, such as battery/light module, a second module 20, such as solar module and a third module 30, such as diffuser module.

The battery/light module 10 may comprise a body 11 housing electrical components, including a rechargeable power source 16, used to power a light source 12 which may be located on a surface, such as surface 120 of the body 11. The surface 120 may be of reflective nature far reflecting and concentrating the light emitted by the light source 12. According to an embodiment, the external surface 13 of the body 11 has hastening means, such as threads 14. First electrical connecting means 15 may be exposed on an external surface of the body 11 and are in electrical connection with the electrical components housed in the body 11. According to an embodiment, the first electrical connecting means 15 are exposed on the external surface 13 of the body 11. According to another embodiment, the first electrical connecting means 15 may be located on the external surface 13 near the inner end 142 of the threads 14 of the light/battery module 10.

The solar module 20 may comprise a body 21 with a solar panel exposed on a surface, such as solar panel 22, for converting solar energy into electrical energy. The solar module 20 may have an opening 201 to allow a user to access the surface 182 of the battery/light module 10. The body 21 may include complementary fastening means, such as reverse threads 24 on its inner surface 23. Second electrical connecting means 25 may be exposed on an inner surface of the body 21 and are in electrical communication with the solar panel 22. According to an embodiment the second, electrical connecting means 25 may be exposed on the inner surface 23 of the body 21. According to a further embodiment, the second electrical connecting means 25 may be located on the inner surface 23 near the outer end 242 of the reverse threads 24 of the solar module 20.

According to a further embodiment the battery/light module 10 may have the fastening means, such as threads 14, and first electrical connecting means 15 on an inner surface of the body 11 and the solar module 20 may have complimentary fastening means, such as reverse threads 24, and second electrical connecting means 25 on an external surface of die body 21.

According to an embodiment, the threads 14 of the battery/light module 10 may releasably mate with the reverse threads 24 of the solar module 20. Through applying torsion between, the solar module 20 and the battery/light module 10, the solar module 20 may be moved closer to the battery/light module 10. When the solar module 20 and the battery/light module 10 are fully secured, i.e., when torsion no longer moves the solar module 20 closer to the battery/light module 10, an electrical connection may be established between the solar panel 22 and the rechargeable power source 16 through the contacts of the first electrical, connecting means 15 with the second electrical connecting means 25. When the solar module 20 is releasably secured to the battery/light module 10 and the assembly is placed in an environment with sufficient solar intensity, the solar panel 22 may provide electrical current to charge the rechargeable power source 16 within the battery/light module 10 with electrical power to power the light source 12. Once the rechargeable power source 16 is recharged, the solar module 20 may be detached from the battery/light module 10 and may be used to recharge the rechargeable power source 16 of another battery/light module 10 with or without the diffuser module 30 being attached to the battery/light module 10.

The first electrical connecting means 15 may be any type of suitable electrical connectors known to those skilled in the art. According to an embodiment, the first electrical connecting means 15 may be a pair of conductive connectors in a spaced arrangement on the external surface 13 of the battery/light module 10. Alternatively, the first electrical connecting means 15 may be a pair of conductive connectors in a spaced arrangement near the inner end 142 of the threads 14. Internal wires (not shown) may connect the rechargeable power source 16 to the first electrical connecting means 15. According to another embodiment, the electrical connecting means 15 may be the ends of the wires connected to the rechargeable power source 16. The ends of the wires may be in a spaced arrangement on the external surface 13 near the inner end 142 of the threads 14.

The second electrical connecting means 25 may be any type of suitable electrical connectors known to those skilled in the art and compatible with the first electrical connecting means 15. According to an embodiment, the second electrical connecting means 25 may be a pair of conductive connectors in a spaced arrangement complimentary to the spaced arrangement of the pair of conductive connectors of the first electrical connecting means 15 on the inner surface 23 of the solar module 20. Alternatively, the second electrical connecting means 25 may be a pair of conductive connectors in a spaced, arrangement complimentary to the spaced arrangement of the pair of conductive connectors of the first electrical connecting means 15 near the outer end 242 of the reverse threads 24. Internal wires (not shown) may make their way through, the body 21 to electrically connect the solar panel 22 to the second electrical connecting means 25. According to another embodiment, the second electrical means may be the ends of the internal wires in electrical communication with the solar panel 22. The ends of the wires may be in a spaced arrangement complimentary to the spaced arrangement of the pair of conductive connectors of the first electrical connecting means 15 on the inner surface 23 near the outer end 242 of the reverse threads 24.

The diffuser module 30 may be releasably secured to battery/light module 10. The diffuser module 30 may have a body 31 which may have a portion 32 configured as a diffuser to disperse the concentrated light emitted by the light source 12. The body 31 may also have an end surface 35 to enclose the diffuser module 30 when releasably secured to the battery/light module 10. The diffuser module 30 may be releasably secured to the battery/light module 10 in any manner, including but not limited to screwing on, snapping on, press fit or friction fit.

Figure 2:
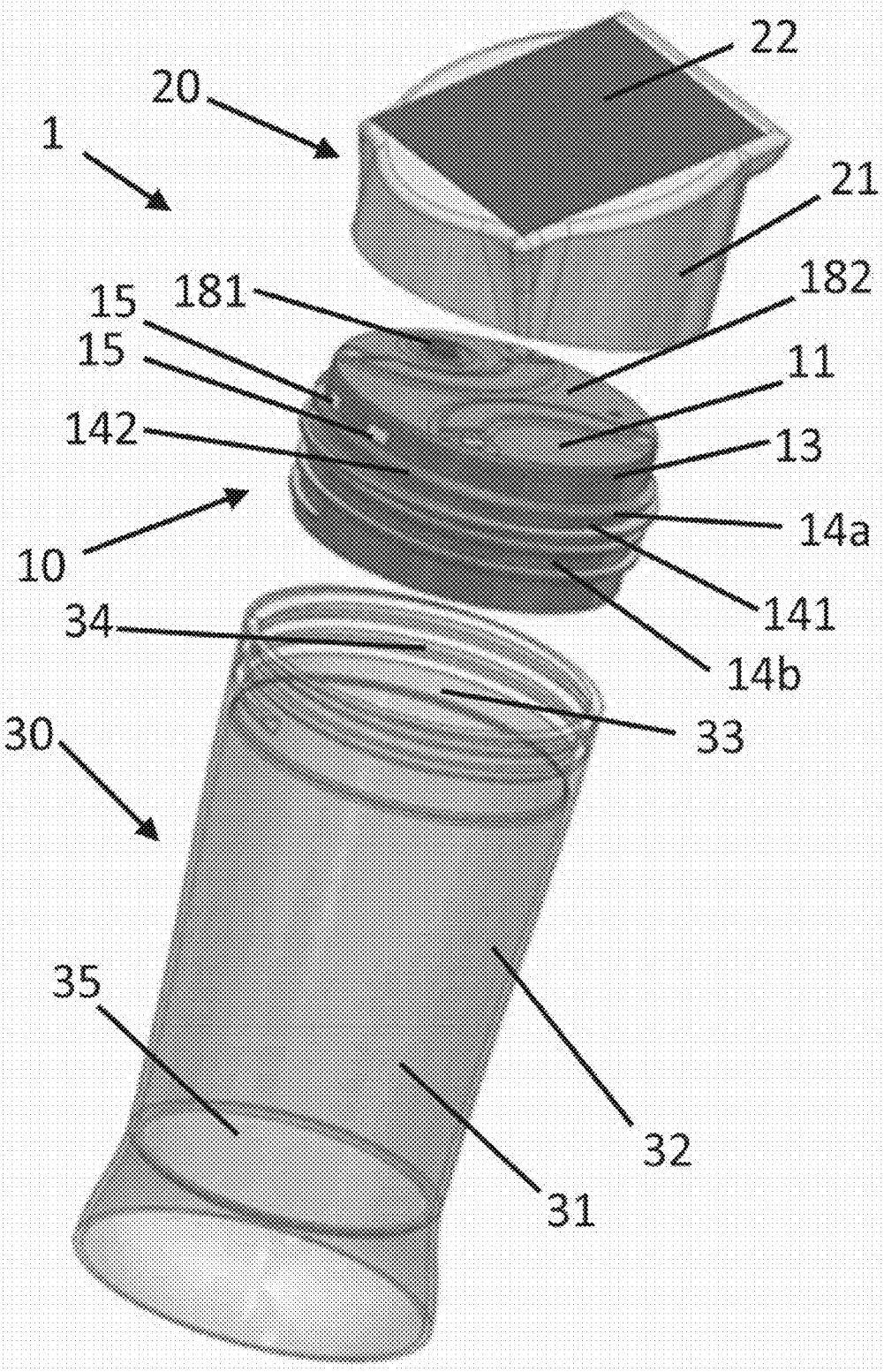
FIG. 2 illustrates a back perspective exploded view of the modular lamp of FIG. 1.
Figure 3:
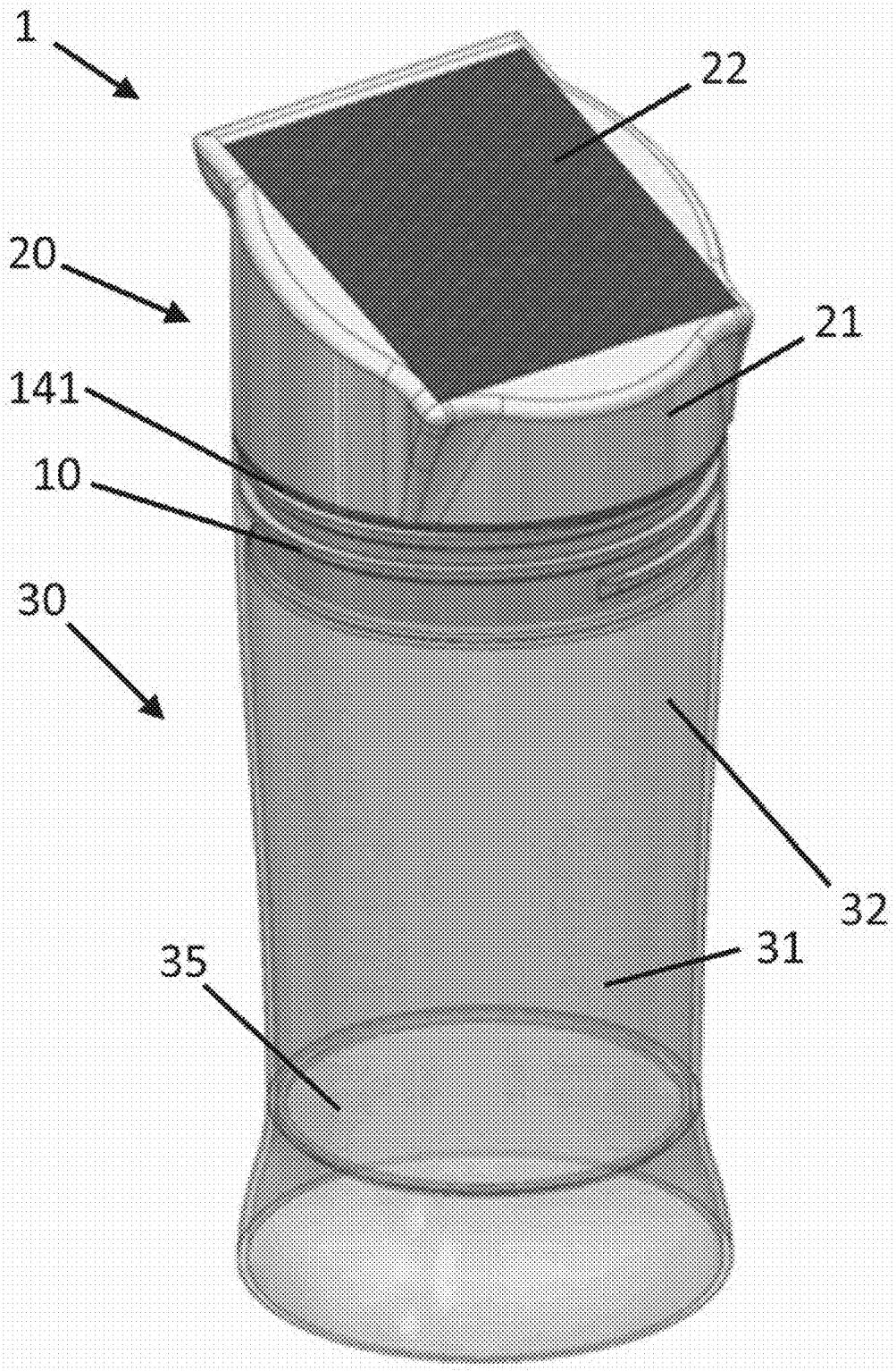
FIG. 3 illustrates a back perspective view of the modular lamp of FIG. 1.
Figure 4:
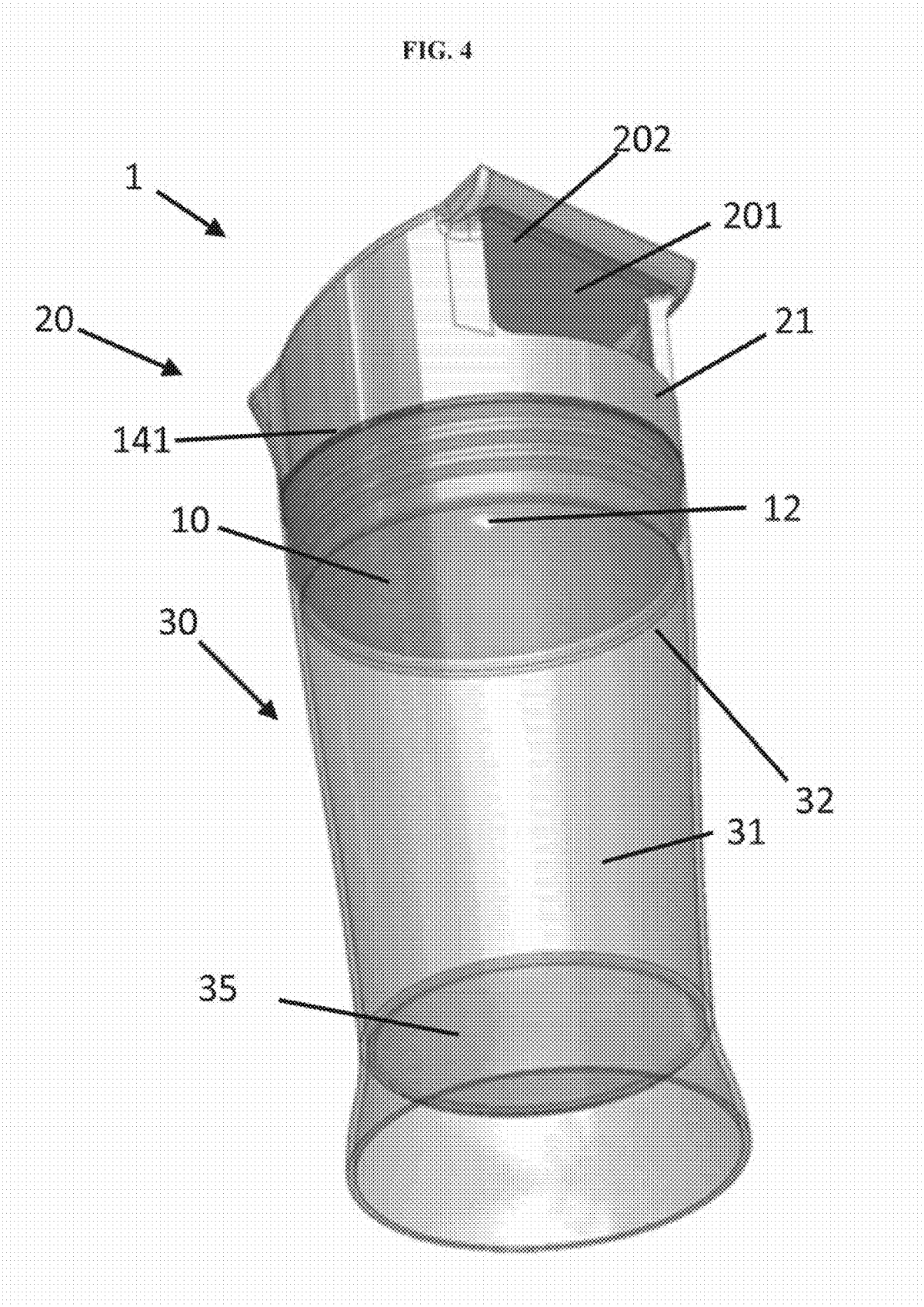
FIG. 4 illustrates a front, perspective view of the modular lamp of FIG. 1.
Figure 5A:
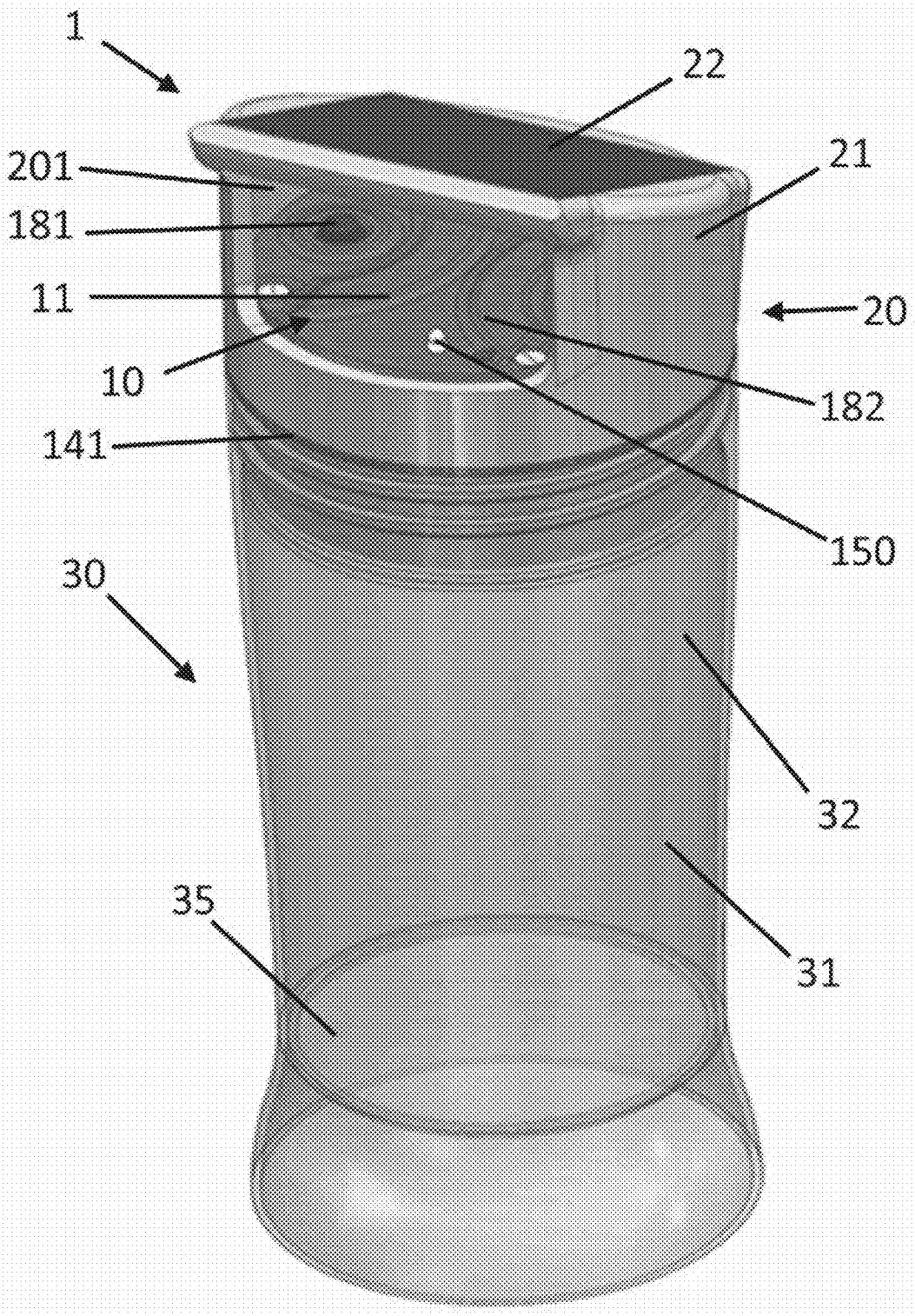
FIG. 5A illustrates a front perspective view of a modular lamp according to a second embodiment of the invention.
Figure 5B:
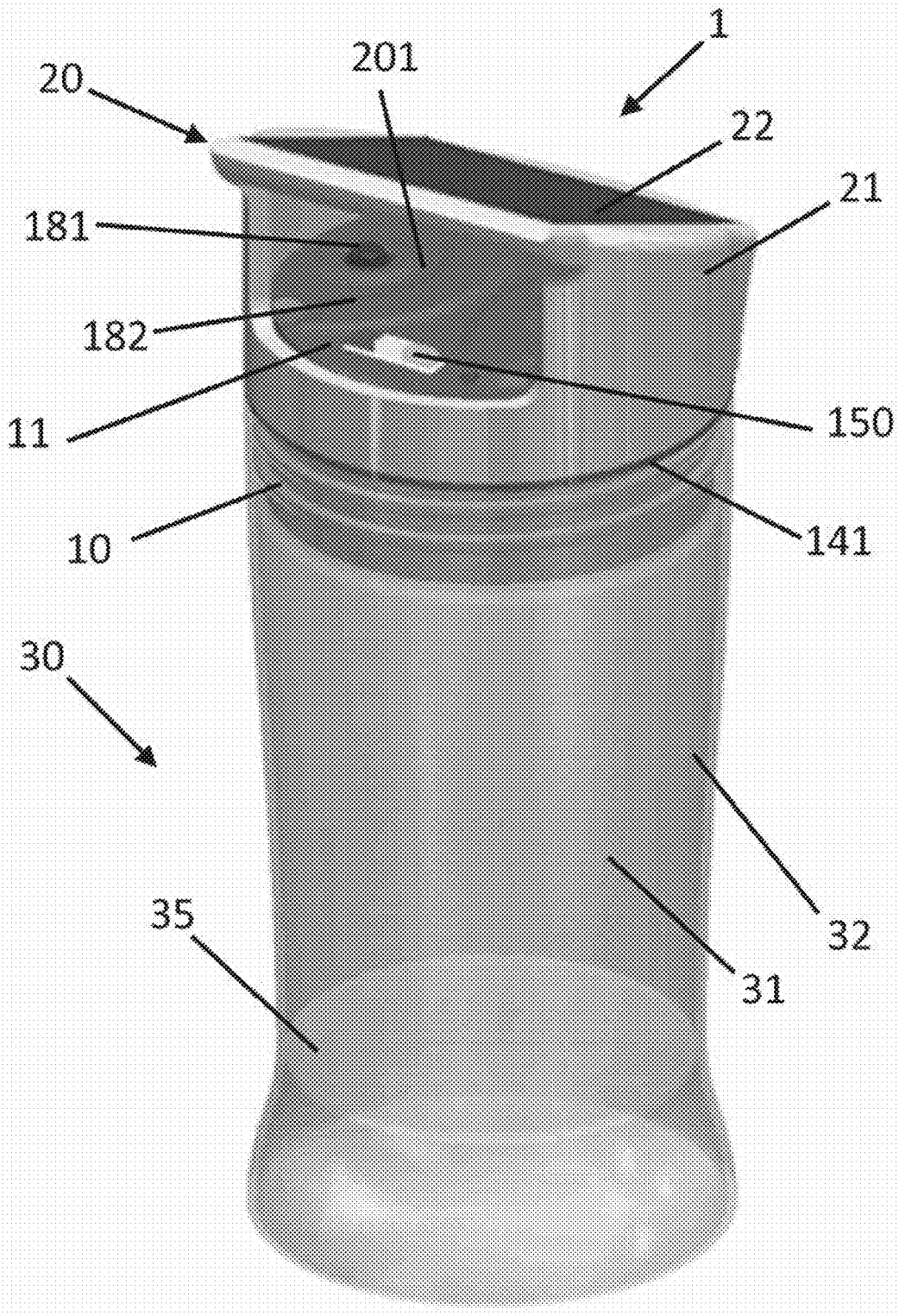
FIG. 5B illustrates a front perspective view of a modular lamp according to a third embodiment of the invention.

According to an embodiment as shown in FIG. 2, threads 14 may be divisible into a first portion of threads 14*a* and a second portion of threads 14*b*. The first portion of threads 14*a* and the second portion of threads 14*b* may be separated by a non-threaded space. The first portion of threads 14*a* and the second portion of threads 14*b* may also be separated by a stopper 141 protruding from the external surface 13. Furthermore, the first portion of threads 14*a* may be oriented in one direction and the second portion of threads 14*b* may be oriented in the opposite direction.

Figure 6:
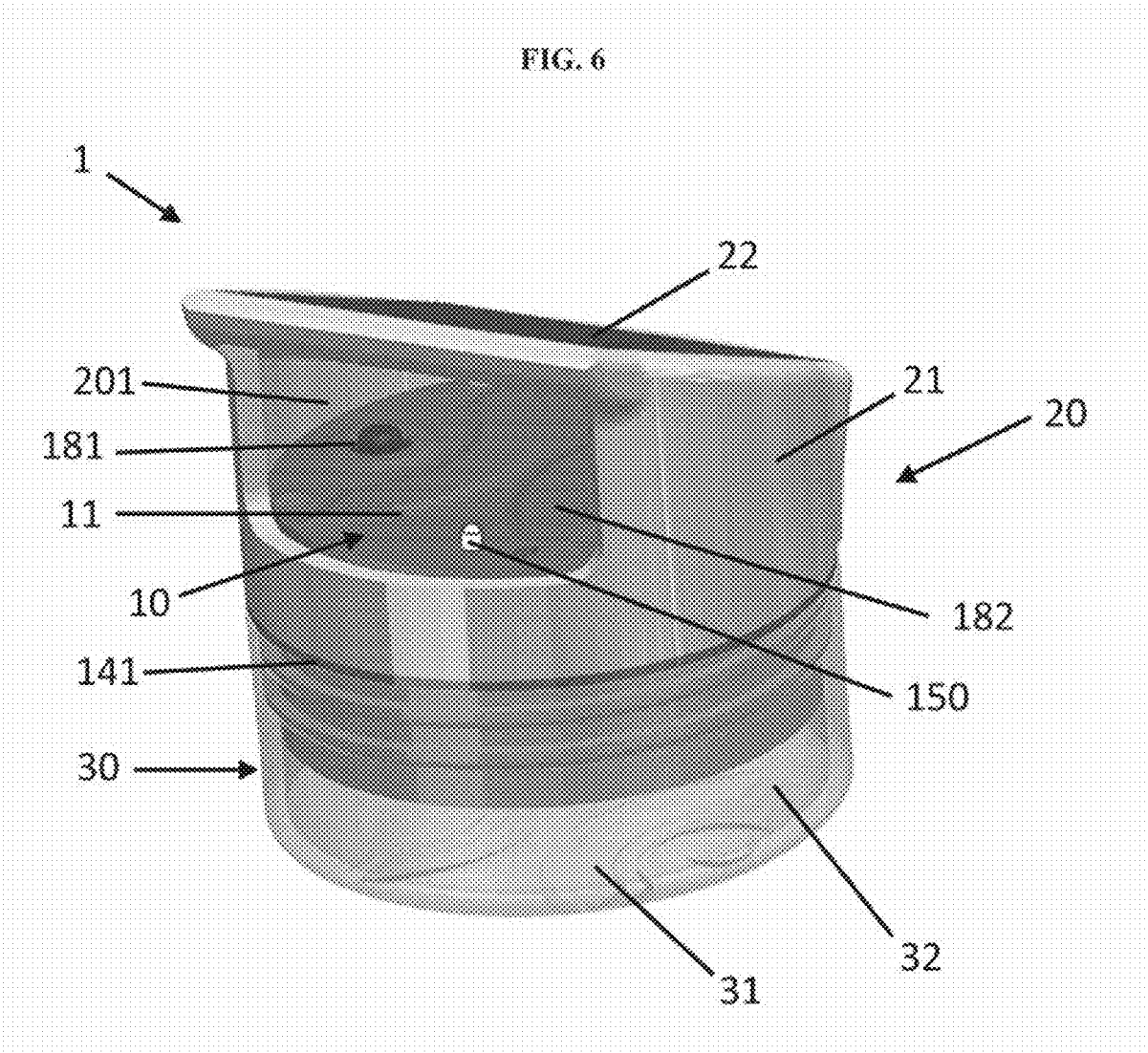
FIG. 6 illustrates a front perspective view of a modular lamp according to a fourth embodiment of the invention.

According to an embodiment, the diffuser module 30 may have reverse threads 34 located on its inner surface 33 of the body 31. According to a further embodiment, when the battery/light module 10 has threads 14 on an inner surface of the body 11, the diffuser module 30 may have the reverse threads 34 located on an external surface of the body 31. The reverse threads 34 of the diffuses module 30 may be configured to mate with at least the second portion of threads 14*b* of the battery/light module 10 for releasably securing the diffuser module 30 to the battery/light module 10 while the reverse threads 24 of the solar module may be configured to mate with at least the first portion of threads 14*a*. The diffuser module 30 is fully secured to the battery/light module 10 when torsion, can no longer be applied between the two modules. The body 31 of the diffuser module 30 may be made of metal, alloy, composite, plastic, glass, ceramic, cardboard, polymer, wood, fiberglass, or any other suitable materials that are durable and able to be shaped into the base form. The diffuser portion 32 may be made using any transparent material such, as clear plastic, translucent or clear polymers (such as acrylic), glass or other suitable materials. Alternatively, the body 31 may be made entirely of one transparent material. According to embodiments of the invention, as shown, in FIGS. 5A, 5B and 6, the diffuser module 30 may be of different lengths.

According to an embodiment the solar panel 22 of the solar module 20 may be of any type, size, shape or power generation capability in consideration of several factors including, but not limited to, the desired power requirements of the battery/light module 10, the cost of the solar panel, and the weight and durability of the solar panel. According to an embodiment, the solar panel 22 may be of a power generation capability sufficient to recharge the rechargeable power source 16 as well as provide power generation capability for an external load. According to another embodiment, the solar panel may have a power generation capability of 0.35W or 0.3W with 5.5V.

According to an embodiment, the rechargeable power source 16 may be one or more rechargeable batteries where such battery or batteries may be any of the following battery types: nickel-cadmium, nickel metal hydride, rechargeable alkaline, lead acid, lithium ion, or any other suitable rechargeable battery known in the art. According to an embodiment, the rechargeable battery or batteries are Ni—MH or $LiFePO_4$.

According to an embodiment, the light source 12 may comprise one or more light-emitting diodes (LEDs), an incandescent light bulb, a fluorescent lamp, a halogen lamp, a lamp based on the light emission of gas (i.e., a neon light or the like) or the like. According to an embodiment, the light source 12 may be one or more 0.5W or 0.6W LEDs. According to further embodiment, the light source 12 may be one or more 1W LEDs.

Figure 7:
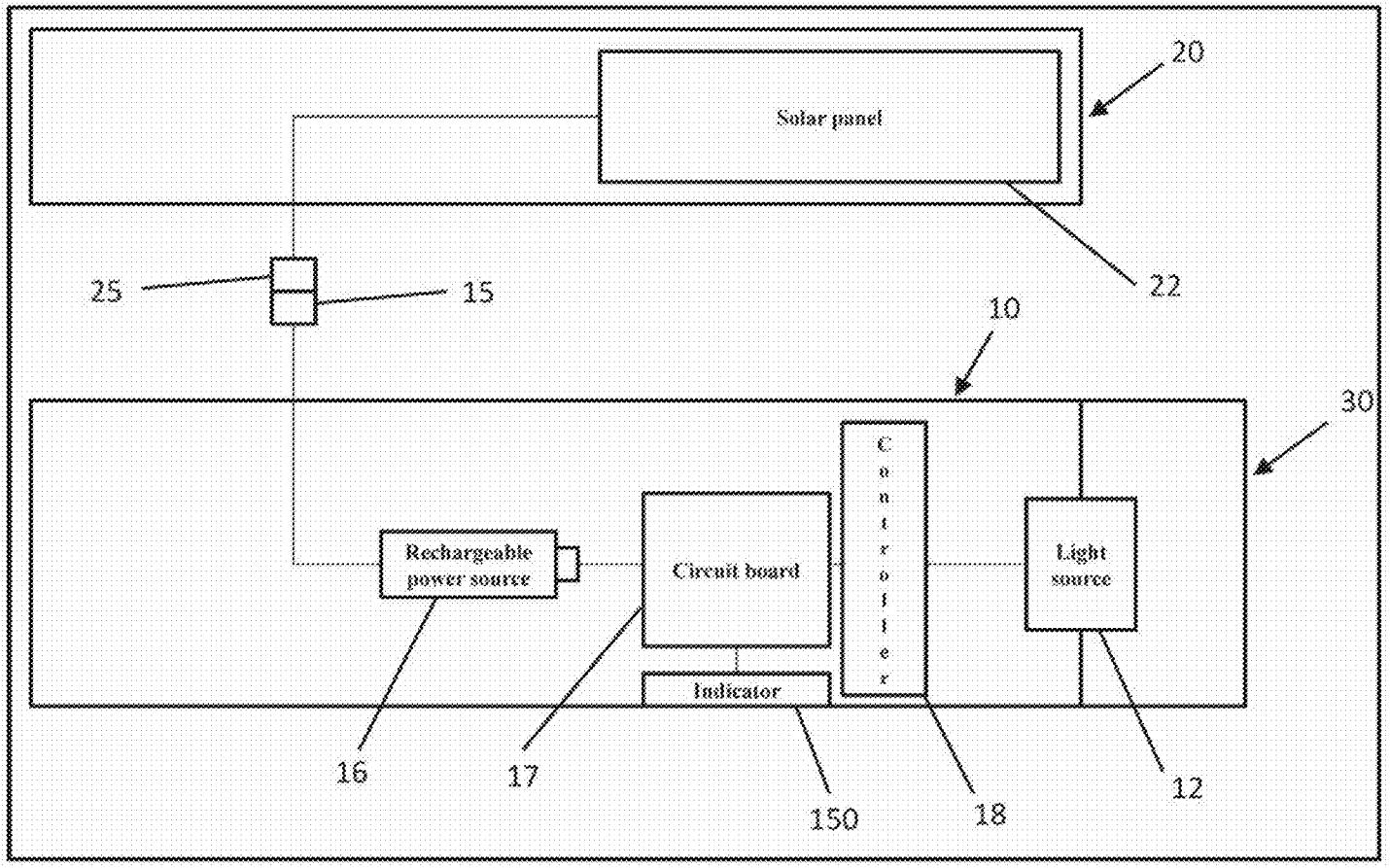
FIG. 7 illustrates a block diagram of a modular lamp according to an embodiment of the invention.
Figure 7B:
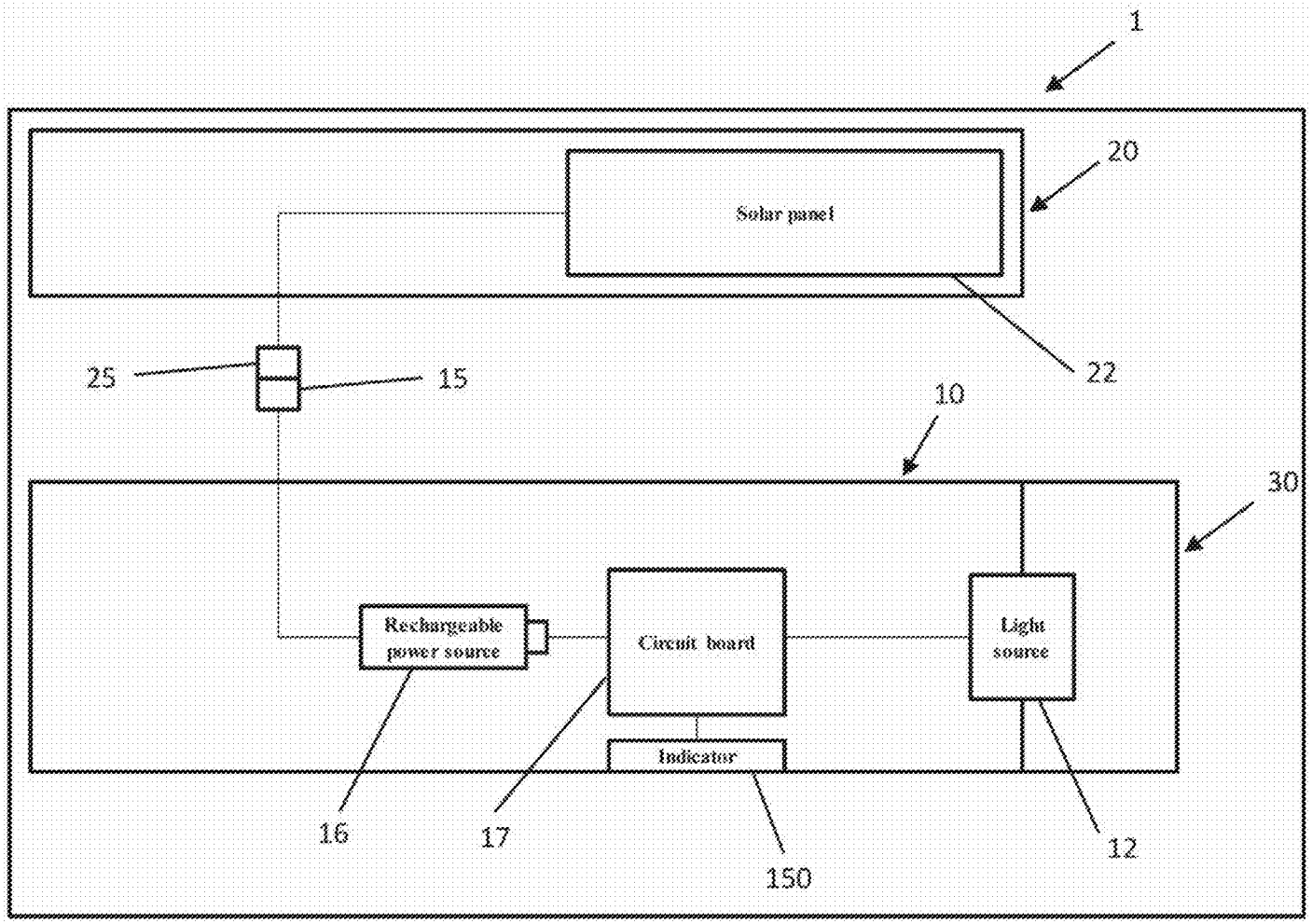
FIG. 7B illustrates a block diagram of a modular lamp according to another embodiment of the invention.
Figure 7C:
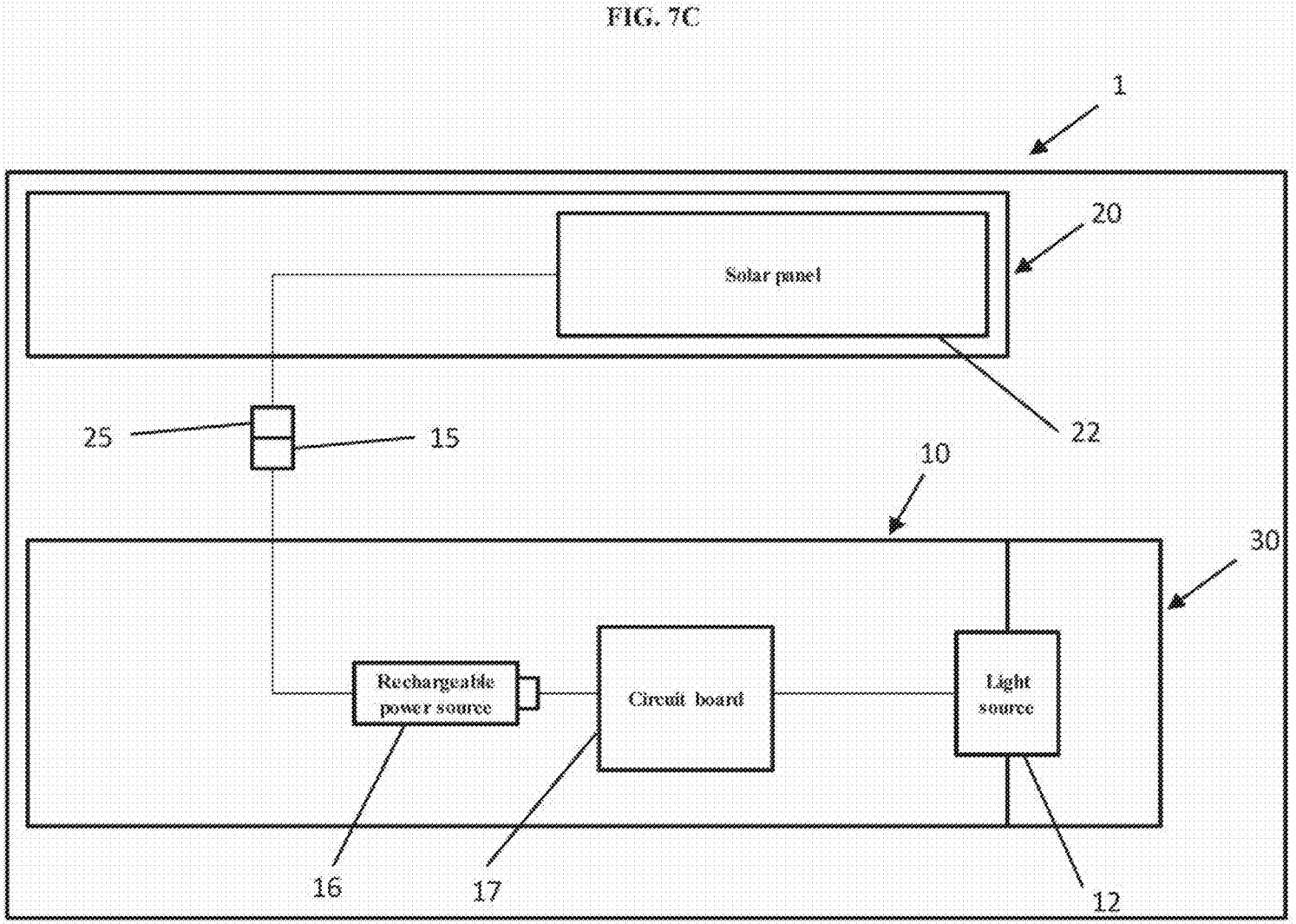
FIG. 7C illustrates a block diagram of a modular lamp according to another embodiment of the invention.
Figure 7D:
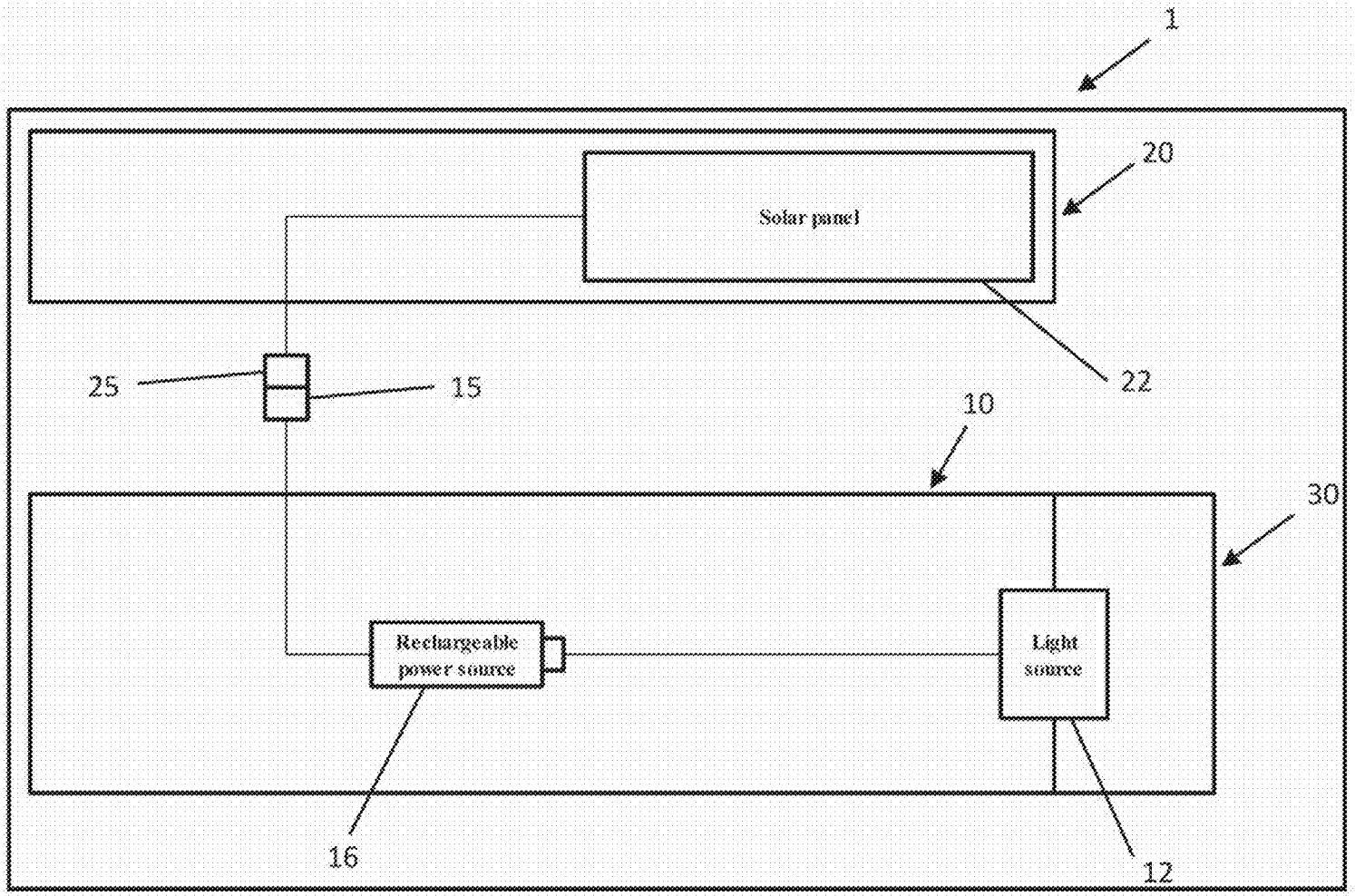
FIG. 7D illustrates a block diagram of a modular lamp according to another embodiment of the invention.
Figure 7E:
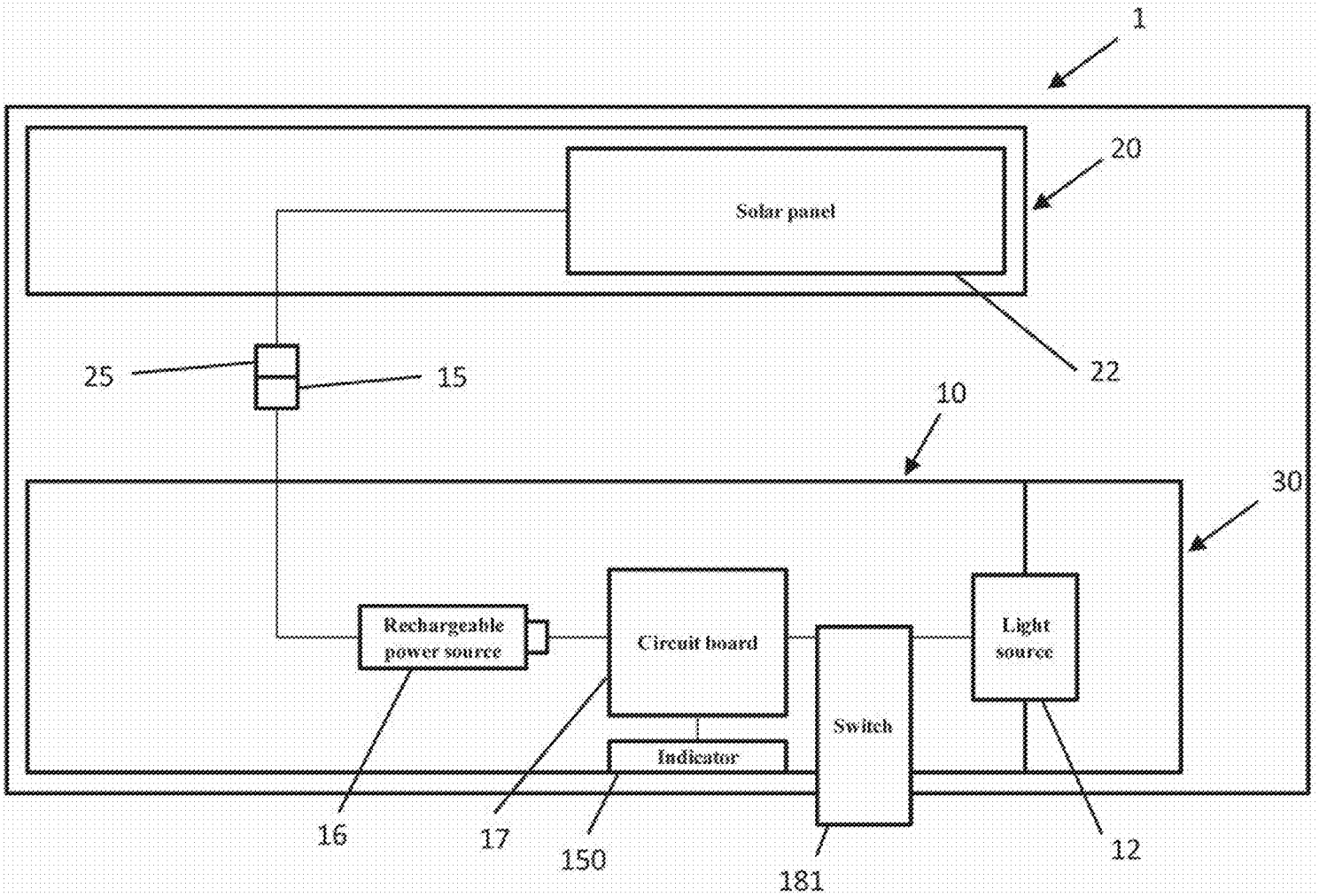
FIG. 7E illustrates a block diagram of a modular lamp according to another embodiment of the invention.

According to the embodiments as shown in FIGS. 22 78, 7C and 7E to 8C, the battery/light module 10 may have a circuit board 17 which may directly or indirectly connect the rechargeable power source 16 to the light source 12. The circuit board 17 may be any suitable circuit, board known in the art. According to an embodiment, the circuit board 17 may be a bread board, a perf board, a strip board or a single-sided or double-sided printed circuit board. As shown in FIGS. 7, 8A and 8B, the battery/light module 10 may have a controller 18 being in communication with the circuit board. 17 to control the solar battery/light module 10. According to an embodiment as shown in FIGS. 8A and 8B, the controller 18 may be configured to turn the light source 12 on and off in response to an actuator, such as switch 181. Alternatively as shown in FIG. 8A and 8B, the controller 18 may be implemented to switch the battery/light module 10 to a light function or a charge function in response to the actuation of switch 181 or in response to a sensor, such as light sensor 19. Switch 181 may be a push button actuation type switch, as shown in FIGS. 2, 5A, 5B and 6, or other appropriate varieties of switch known in the art, e.g., a toggle actuation, type switch, a rocket actuation type switch, a slide dimmer type switch or a wheel dimmer type switch. Light sensor 19 may be used in communication with the controller 18 in order to detect the absence of ambient light. Following such detection, the controller 18 may activate the light source 12 as discussed above. Furthermore, a battery charge indicator 150, as shown in FIGS. 5A to 7B and 7E to 8C, may be in electrical communication with the rechargeable power source 16 to provide information on the charge level of the power source 16.

Figure 8A:
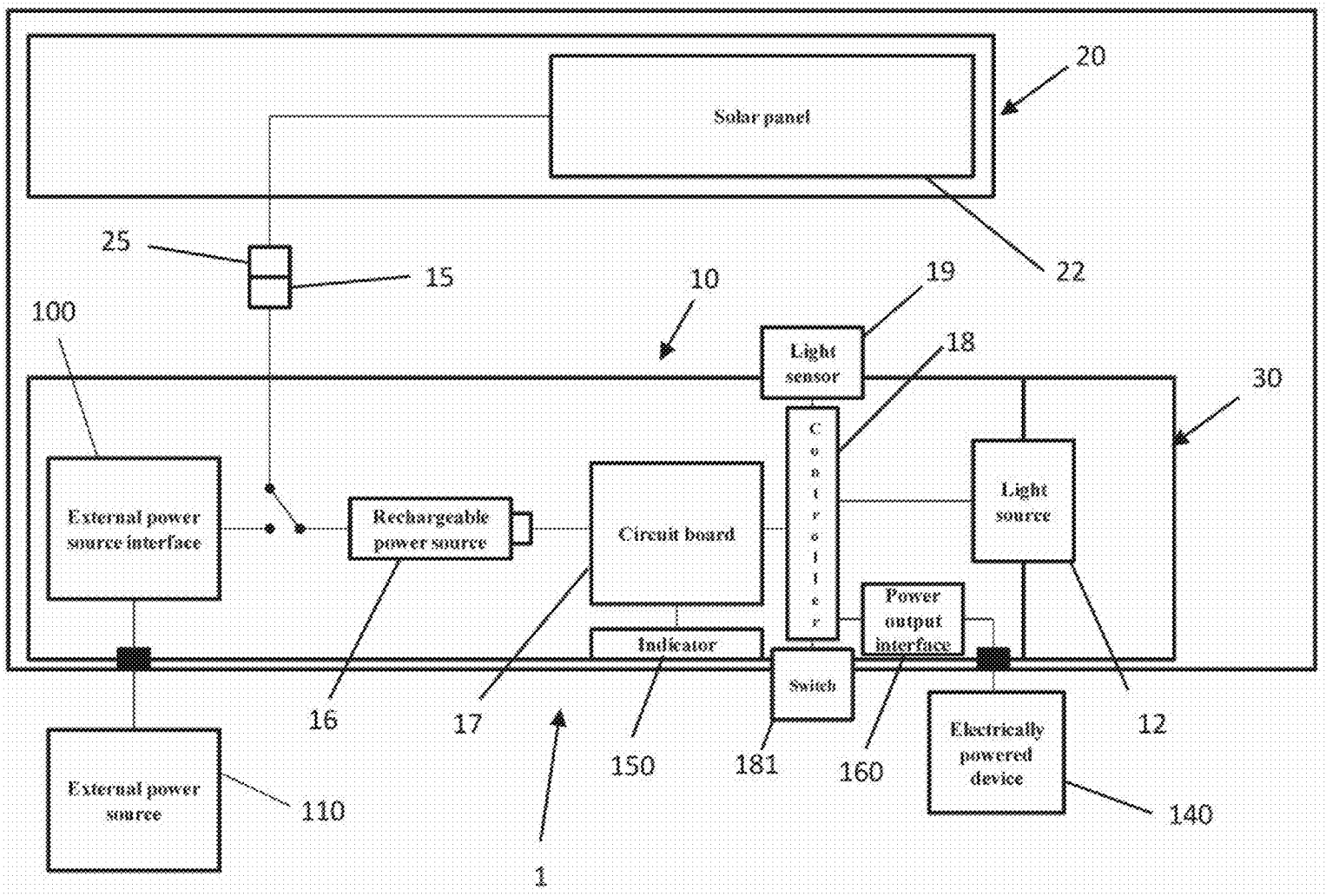
FIG. 8A illustrates a block diagram of a modular lamp according to another embodiment of the invention.
Figure 8B:
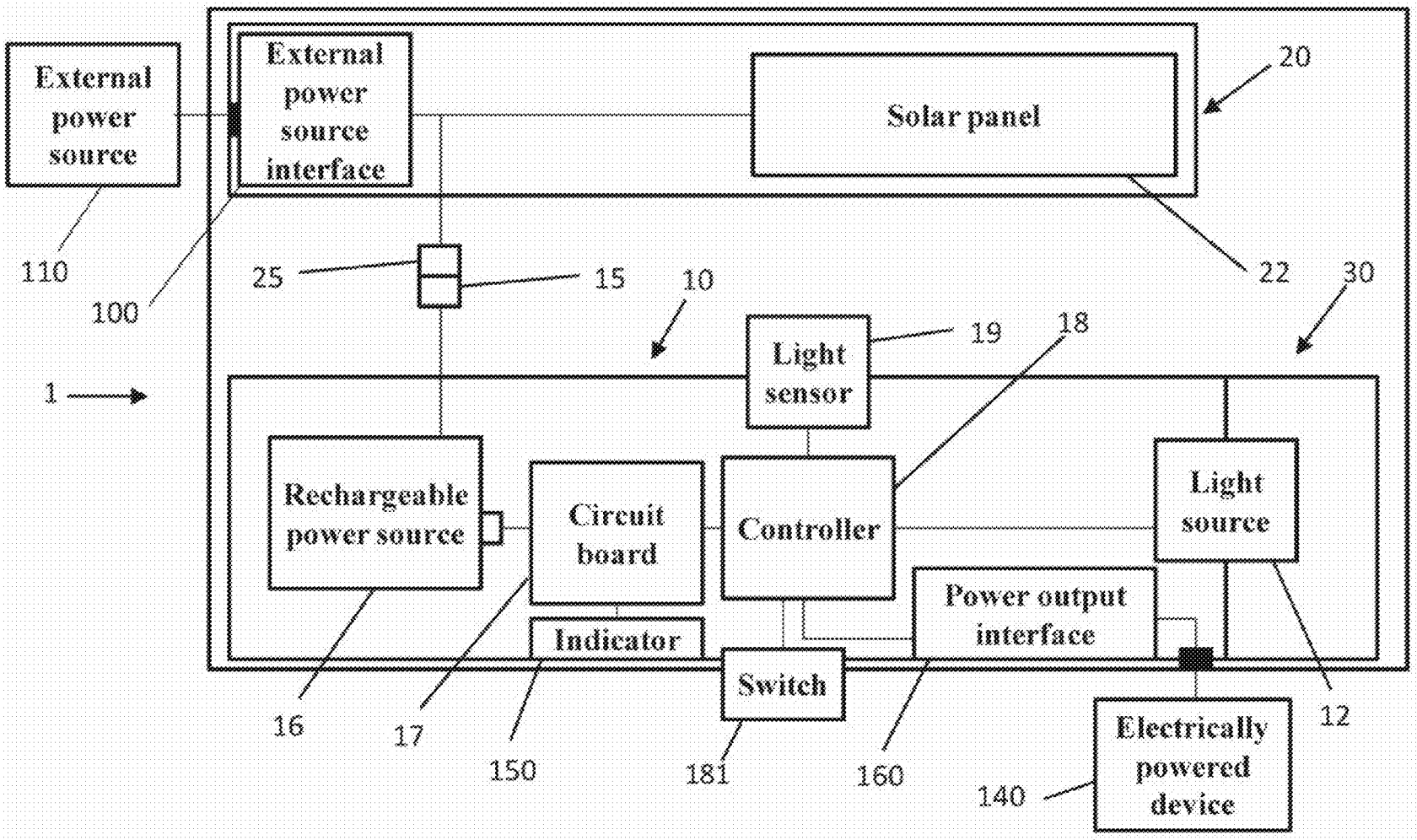
FIG. 8B illustrates a block diagram of a modular lamp according to another embodiment of the invention.
Figure 8C:
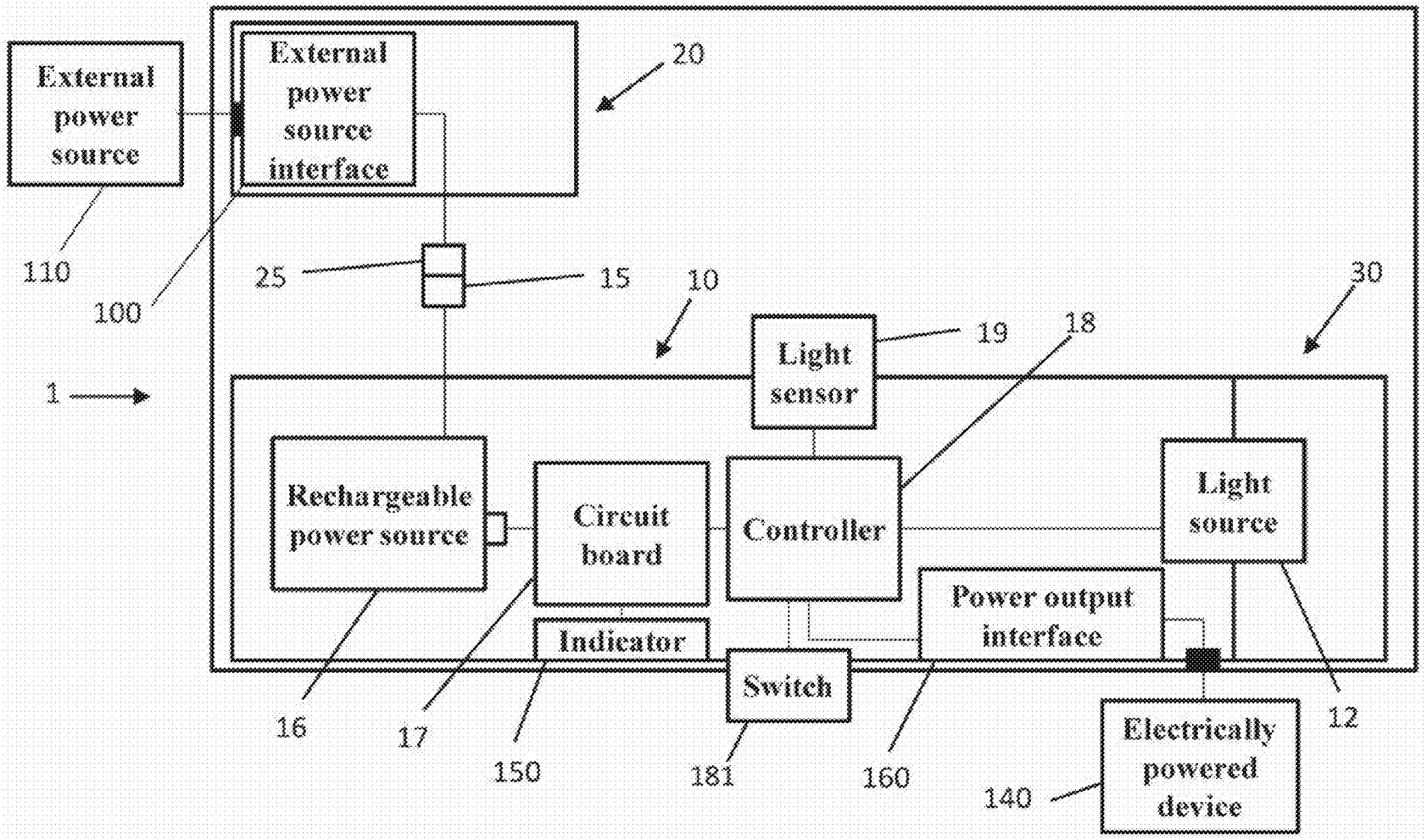
FIG. 8C illustrates a block diagram of a modular lamp according to a further embodiment of the invention.

According to an embodiment as shown in FIGS. 8A to 8C, the battery/light module 10 may have a power output interface 160 in electrical communication with the circuit board 17 for supplying power to an electrically powered device 140 when the power output interface 160 is electrically connected to the electrically powered device 140. The power output, interface 160 may comprise a Universal Serial Bus (USB) input, AC input, or DC input to connect the electrically powered device 140 to the rechargeable power source 16. The electrically powered device 140 may be a mobile phone, an audio/video player, a digital camera, or any other electronic device powered by batteries or other powered source. According to an embodiment, a user may use the battery/light module 10 to power or recharge the electrically powered device 140. The electrically powered device 140 may be powered while the rechargeable power source 16 is fully charged or while the solar panel 22 is recharging the rechargeable power source 16.

According to an embodiment as shown in FIGS. 8A and 8B, the solar lamp 1 may have an external power source interface 100 for receiving electrical power from an external power source 110 to recharge the rechargeable power source 16 when the external power source interface 100 is in electrical communication with the external power source 110. The external power source interface 100 may be housed in the battery/light module 10 and be in electrical communication with the rechargeable power source 16. Alternatively, the external power source interface 100 may be housed in the solar module 20 and be in electrical communication with the second electrical connecting means 25. The external power source interface 100 may comprise a Universal Serial Bus (USB) input, AC input, DC input or an inductive charging input to connect the rechargeable power source 16 to the external power source 110. According to an embodiment, the external power source interface 100 may comprise a device where mechanical work which may be provided by a user generates electrical energy to recharge the rechargeable power source 16. The operable device may be a linear reciprocating shake type device or a hand crank dynamo. According to another embodiment, the external power source. 110 may be an electrical outlet connected to an electrical grid, one or more high-capacity batteries, an electrical generator or any other suitable external power source known in the art. The electrical generator may be an engine generator, a vehicle-mounted generator, a user-powered generator, an electromagnetic generator, e.g., a dynamo or induction generator, a fluid energy converting power generator, e.g., a wind power generator or a hydroelectric power generator.

According to an embodiment as shown in FIG. 8C, the second module is configured to house the external power source interface 100 and be in electrical communication with the second electrical connecting means 25. The external power source interface 100 may comprise a Universal Serial Bus (USB) input, AC input DC input or an inductive charging input to connect the rechargeable power source 16 to the external power source 110. According to an embodiment, the external power source interface 100 may comprise a device where mechanical work which may be provided by a user generates electrical energy to recharge the rechargeable power source 16. The operable device may be a linear reciprocating shake type device or a hand crank dynamo. According to another embodiment, the external power source 110 may be an electrical outlet connected to an electrical grid, one or more high-capacity batteries, an electrical generator or any other suitable external, power source known in the art. The electrical generator may be a solar power generator, an engine generator, a vehicle-mounted generator, a user-powered generator, an electromagnetic generator, e.g., a dynamo or induction generator, a fluid, energy converting power generator, e.g., a wind power generator or a hydroelectric power generator.

Figure 9:
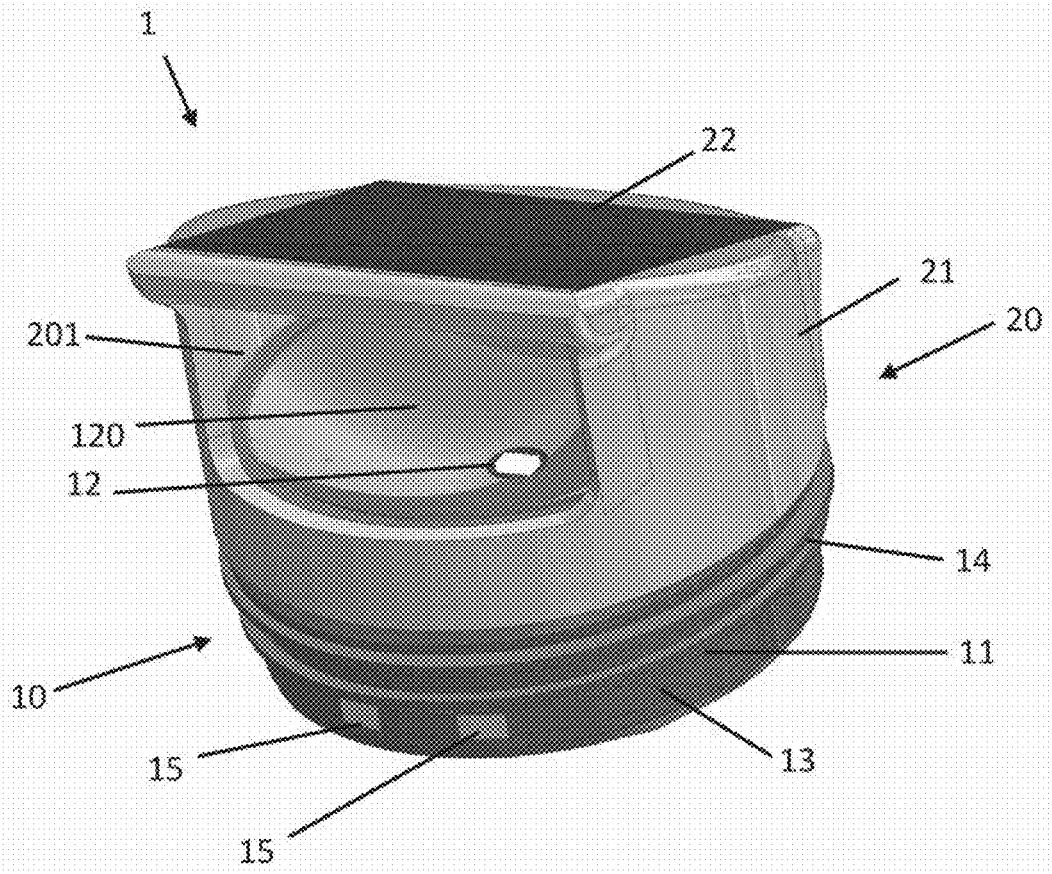
FIG. 9 illustrates a front perspective view of a modular lamp according to a fifth embodiment of the invention.
Figure 10:
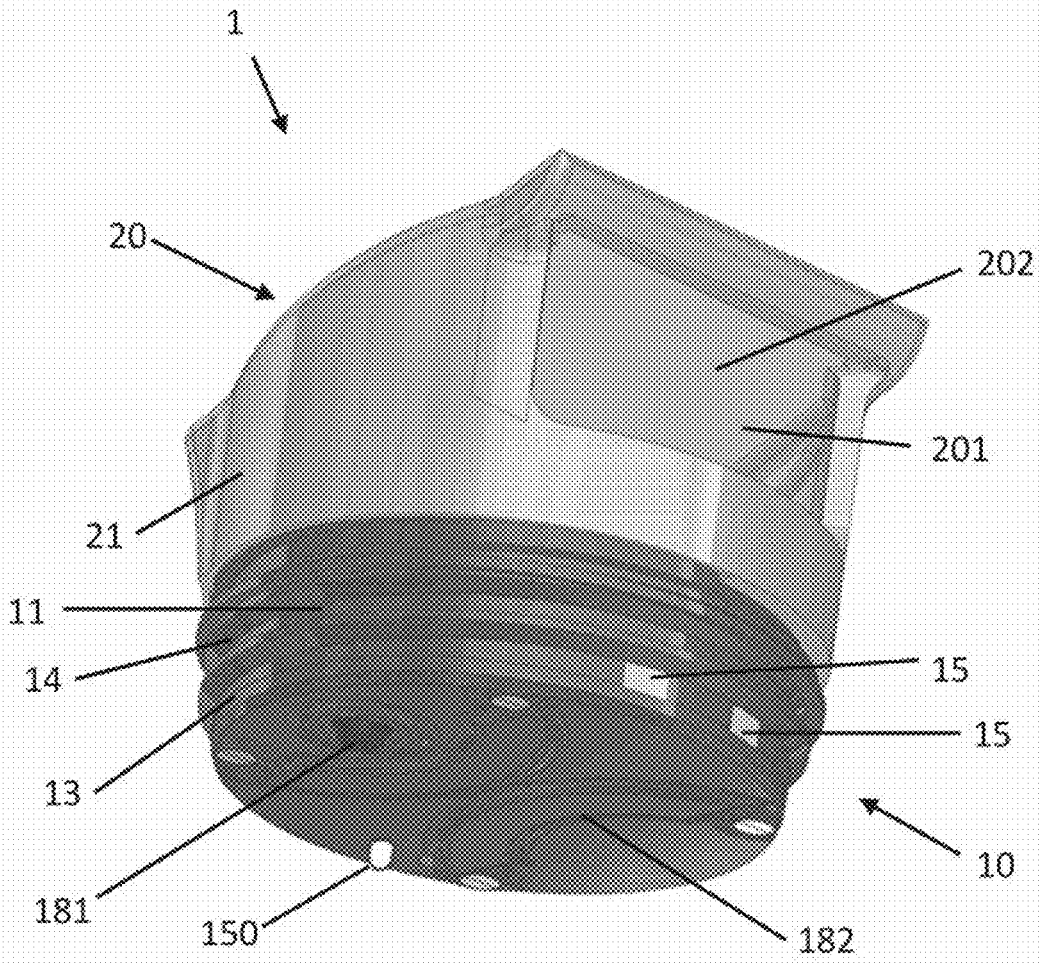
FIG. 10 illustrates a side perspective view of the modular lamp of FIG. 9.

According to embodiments as shown, in FIGS. 9 and 10, the solar module 20 may he releasably secured to at least the second portion, of threads 14*b* (as shown in FIG. 2) of the battery/light module 10. The solar module 20 may have a reflective surface 202 for reflecting the light emitted by the light source 12 and directing the light through, the opening 201. The reflective surface 202 may be a regular plastic surface or a high gloss plastic surface or a piece of any suitable reflective material, e.g., aluminum or tin.

Figure 11:
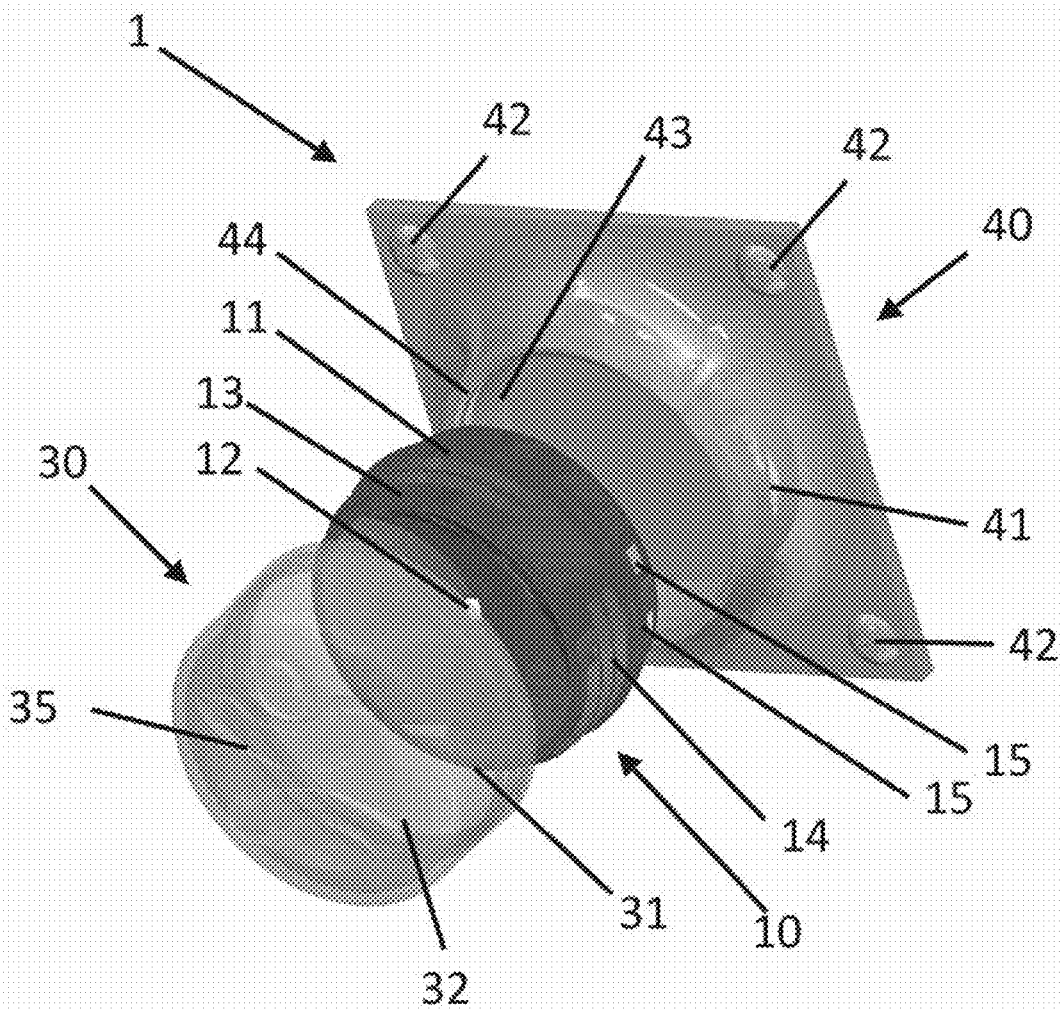
FIG. 11 illustrates a front perspective exploded view of a modular lamp secured to a wall mount according to an embodiment of the invention.
Figure 12:
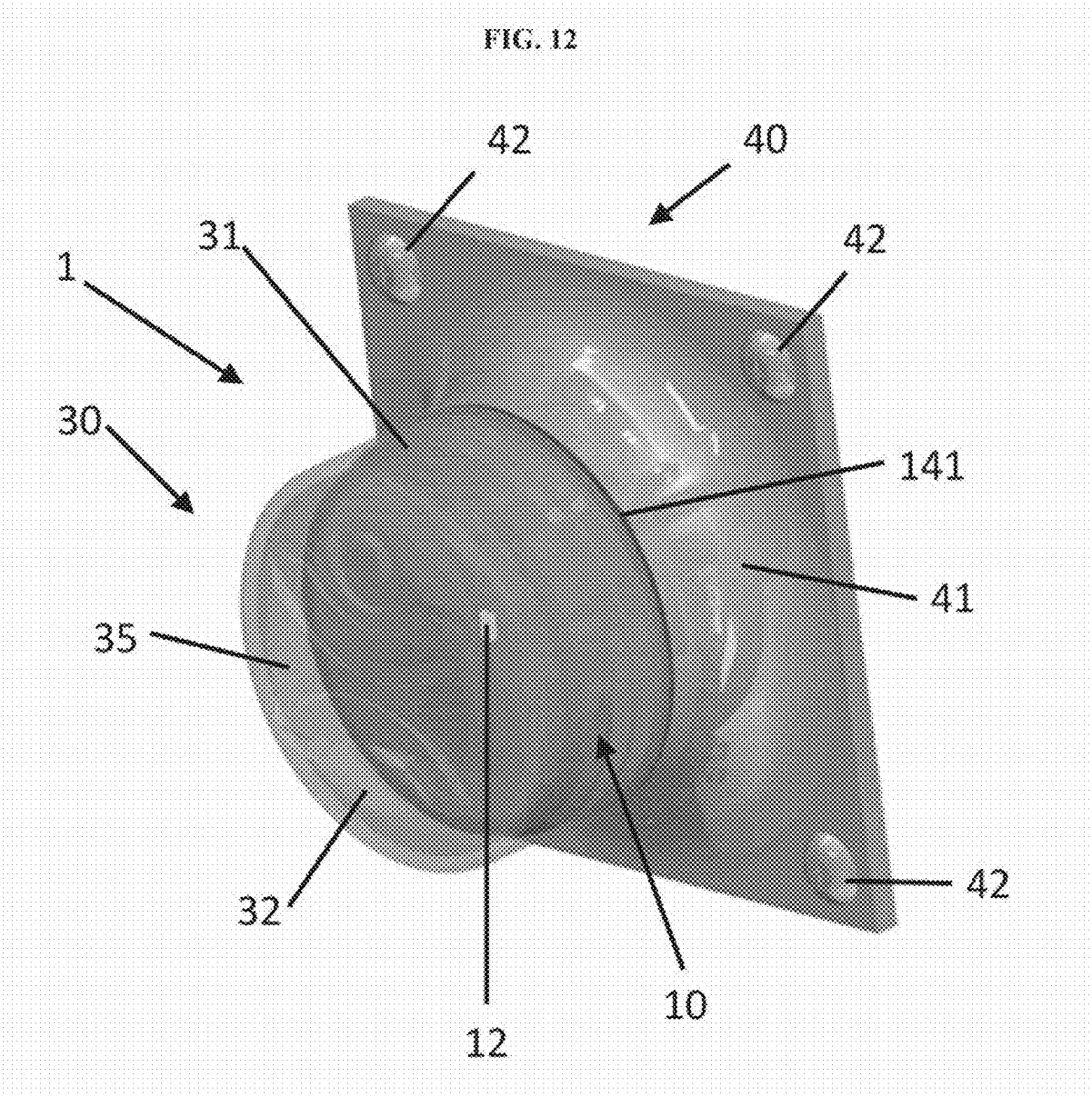
FIG. 12 illustrates a front perspective view of the modular lamp secured to a wall mount of FIG. 11.

Referring to FIGS. 11 and 12, the battery/light module 10 may be releasably secured to a wall mount 40. Such configuration may allow a user to releasably secure the solar lamp 1 to a supportive structure such as a wall, ceiling or any other structure capable of supporting the solar lamp 1. This may, for example, be for storing the solar lamp 1 when not in use or to allow the solar lamp 1 to provide light to a room. The wall mount 40 may have a body 41 which may have reverse threads 44 located on its inner surface 43. The reverse threads 44 of the wall mount 40 may be configured to mate with the threads 14 of the battery/light module 10 for releasably securing the battery/light module 10 to the wall mount 40. The battery/light module 10 may be fully secured to the wall mount 40 when torsion can no longer be applied, between the two modules to move them closer together. The body 41 of the wall mourn 40 may be made of any suitable materials known to those skilled in the art. According to an embodiment, the wall mount 40 may have fasteners 42 which may be used to secure the wall mount 40 to the supportive structure. According to a further embodiment, the wall mount 40 may be inserted in an opening present on the surface of the supportive structure. Alternatively, the opening present on the surface of the supportive structure may have threads which are compatible with the threads of the battery/light module 10 for releasably securing the battery/light module 10 into the opening present on the surface of the supportive structure.

Figure 13:
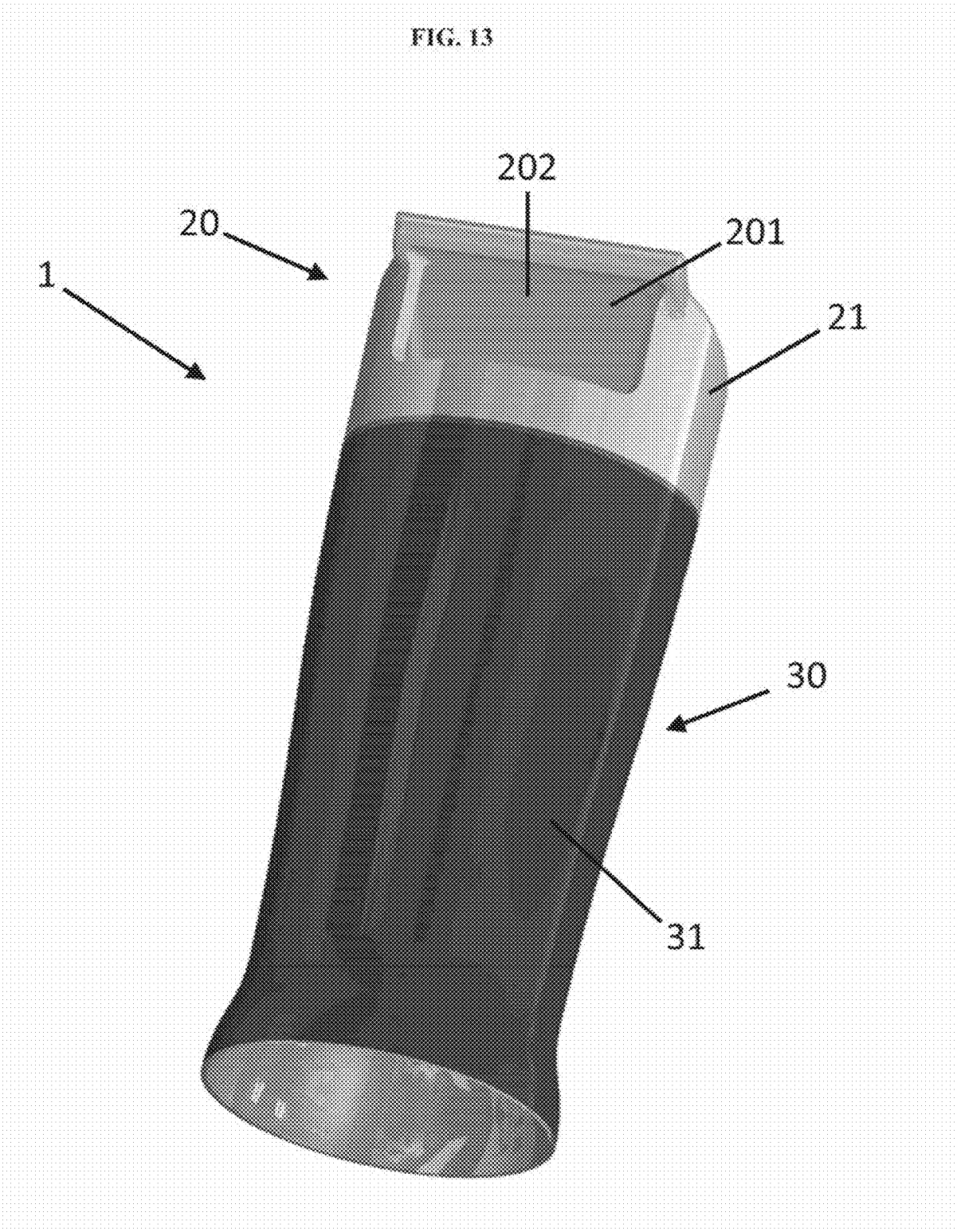
FIG. 13 illustrates a front perspective view of a modular lamp in a flashlight configuration according to an embodiment of the invention.
Figure 14:
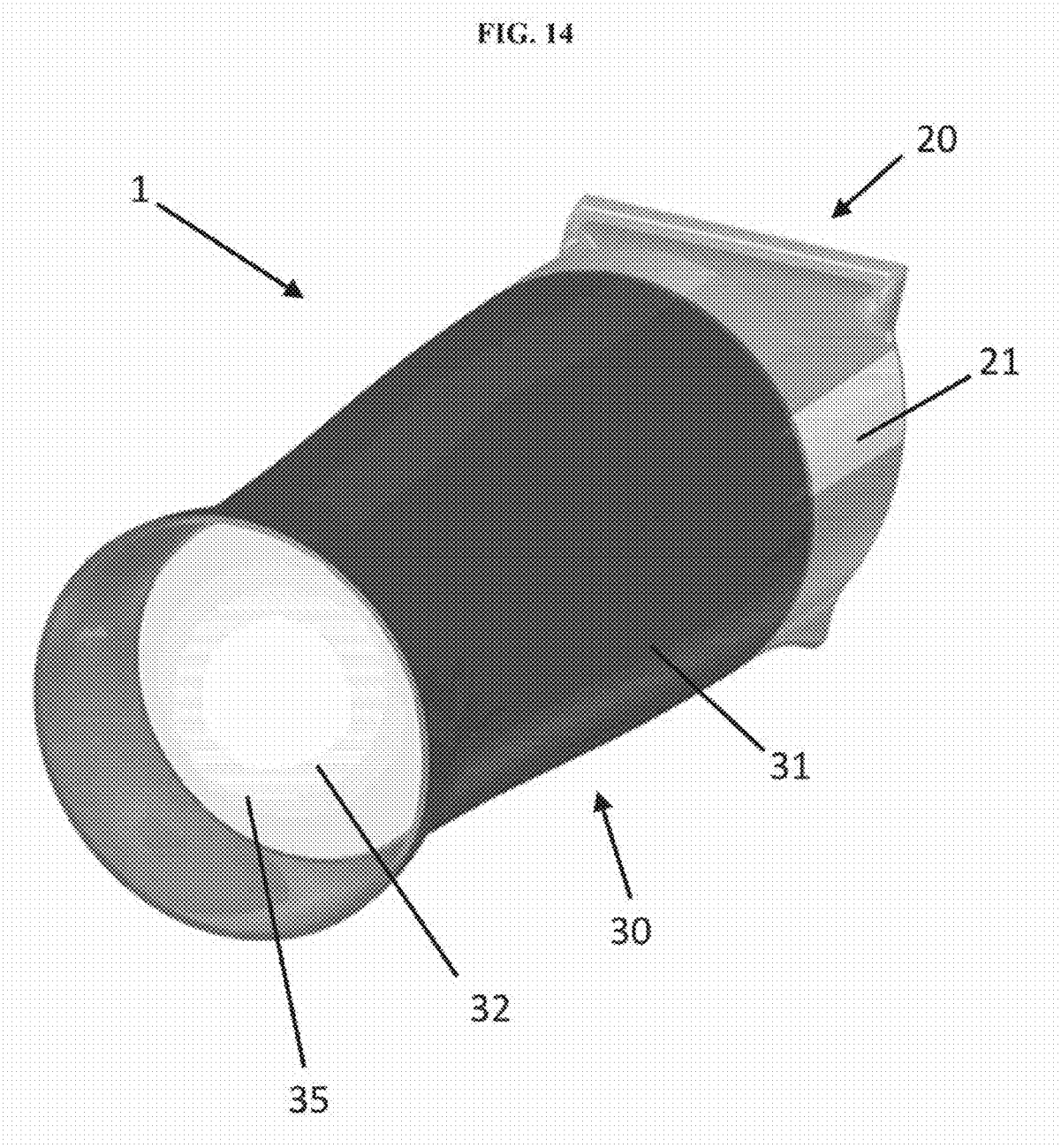
FIG. 14 illustrates a bottom perspective view of the modular lamp in a flashlight configuration of FIG. 13.

According to an embodiment as shown in FIGS. 13 and 14, the solar lamp 1 may be used in a flashlight configuration. The diffuser module 30 may have a body 31 which, may be made of an opaque material and a transparent or translucent end surface 35. The end surface 35, which may enclose the diffuser module 30, may act as a lens for transmitting the emitted light. The end surface 35 may be made of any transparent material such as clear plastic, translucent or clear polymers (such as acrylic), glass or other suitable materials. The light emitted by the light source 12 may be concentrated, by the surface 120 of the battery/light module 10 into a light beans which is directed towards the end surface 35.

According to an embodiment, the battery/light module 10, the solar module 20, and the diffuse module 30 may comprise water sealing structures to prevent the solar lamp 1 from being damaged by humidity or water.

According to an embodiment the fastening means of the battery/light module 10 and the complimentary fastening means of the solar module 20 may be configured tor releasably securing the solar module 20 to the battery/light module 10 in other manners but not limited to snapping on, press fit or friction fit. The fastening means of the battery/light module 10 may releasably engage with the complimentary fastening means of the solar module 20. Through applying a force between the solar module 20 and the battery/light module 10, the solar module 20 may be moved closer to the battery/light module 10. When the solar module 20 and the battery/light module 10 are fully secured, i.e., when the solar module 20 cannot move closer to the battery/light module 10, an electrical connection may be established between the solar panel 22 and the rechargeable power source 16 through the contacts of the first electrical connecting means 15 with the second electrical connecting means 25.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A modular lamp comprising:

a first module comprising a thread formation, a light source for emitting light, a rechargeable power source for storing electrical power, the rechargeable power source being in electrical communication with the light source for transmitting electrical power from the rechargeable power source to the light source, and a first electrical connecting means located on the thread module of the first formation and in electrical communication with the rechargeable power source;

a second module comprising a thread formation configured for mating with the thread formation of the first module, the second module comprising a solar panel assembly for converting solar power into electrical power and a second electrical connecting means located on the thread formation of the second module and being in electrical communication with the solar panel assembly, whereby when the first module is fully and releasably secured to the second module by rotatably engaging the thread formation of the first module with the thread formation of the second module, the first electrical connecting means is engaged with the second electrical connecting means thereby allowing electrical communication between the solar panel assembly and the rechargeable power source;

wherein the first electrical connecting means is a pair of conductive connectors in a substantially circumferentially spaced arrangement located near an inner end of the thread formation of the first module and the second electrical means is a pair of conductive connectors in a substantially circumferentially spaced arrangement complementary to the spaced arrangement of the pair of conductive connectors of the first electrical connecting means and located near an outer end of the thread formation of the second module.

2. The modular lamp of claim 1, further comprising a diffuser for dispersing light emitted by the light source.

3. The modular lamp of claim 1, wherein a third module is releasably secured to the first module, the third module being configured for dispersing light emitted by the light source.

4. The modular lamp of claim 3, wherein the third module has a thread formation configured for rotatably engaging with at least a portion of the thread formation of the first module when the third module is releasably secured to the first module.

5. The modular lamp of claim 1, further comprising a controller being in electrical communication with the rechargeable power source and the light source for controlling the illumination of the light source.

6. The modular lamp of claim 5 wherein the controller is configured to receive an indication of the level of ambient light near the solar lamp from a light sensor.

7. The modular lamp of claim 1, further comprising an external power source interface in electrical communication with the rechargeable power source.

8. The modular lamp of claim 1, further comprising a power output interface in electrical communication with the rechargeable power source.

9. An apparatus for use with a module comprising a thread formation, a light source for emitting light, a rechargeable power source for storing electrical power, the rechargeable power source being in electrical communication with the light source for transmitting electrical power from the rechargeable power source to the light source and a first electrical connecting means located on the thread formation of the module and in electrical communication with the rechargeable power source, the apparatus comprising:

a body having a thread formation being configured for mating with the thread formation of the module for releasably securing the body to the light module, the body comprising a power source assembly for providing electrical power; and a second electrical connecting means located on the thread formation of the body and in electrical connection with the power source assembly;

whereby when the body is releasably and fully secured to the module by rotatably engaging the thread formation of the body with the thread formation of the module, the first electrical connecting means is engaged with the second electrical connecting means thereby allowing electrical communication between the power source assembly and the rechargeable power source;

wherein the first electrical connecting means is a pair of conductive connectors in a substantially circumferentially spaced arrangement located near an inner end of the thread formation of the first module and the second electrical means is a pair of conductive connectors in a substantially circumferentially spaced arrangement complementary to the spaced arrangement of the pair of conductive connectors of the first electrical connecting means and located near an outer end of the thread formation of the second module.

10. The apparatus of claim 9, wherein the power source assembly comprises a solar panel assembly for converting solar power into electrical power.

11. The apparatus of claim 9, wherein the power source assembly comprises an external power source interface.

12. The apparatus of claim 9, wherein the power source assembly comprises means for converting mechanical energy into electrical power.

13. The apparatus of claim 12, further comprising means for a user to supply mechanical energy to the power source assembly.

* * * * *